United States Patent [19]

Gatsis

[11] 4,312,747

[45] Jan. 26, 1982

[54] PROCESS FOR DEASHING PRIMARY COAL LIQUIDS

[75] Inventor: John G. Gatsis, Des Plaines, Ill.

[73] Assignee: UOP Inc., Des Plaines, Ill.

[21] Appl. No.: 122,163

[22] Filed: Feb. 19, 1980

[51] Int. Cl.[3] ..... C10G 1/00

[52] U.S. Cl. ..... 208/177; 208/8 LE

[58] Field of Search ..... 208/177, 8 LE

[56] References Cited

U.S. PATENT DOCUMENTS 3,583,900 6/1971 Gatsis ..... 208/8 LE 4,090,958 5/1978 Leonard ..... 210/54

4,225,420 9/1980 Rhodes ..... 208/177

*Primary Examiner*—Delbert E. Gantz

*Assistant Examiner*—William Leader

*Attorney, Agent, or Firm*—James R. Hoatson, Jr.; John G. Cutts, Jr.; William H. Page II

[57] ABSTRACT

A process for deashing primary coal liquids with a selective multi-solvent extraction wherein the coal liquids and a primary solvent are contacted initially at a temperature greater than the temperature at which the deashing extraction occurs.

6 Claims, No Drawings

PROCESS FOR DEASHING PRIMARY COAL LIQUIDS

BACKGROUND OF THE INVENTION

This invention relates to a process for deashing coal liquids with a selective solvent extraction whereby the coal liquids and a primary selective solvent are contacted initially at a temperature greater than the temperature at which the deashing extraction occurs. A secondary selective solvent is subsequently admixed at a temperature less than that of the primary solvent admixture. After coal extract is deashed to a very low level, the coal extract may then be upgraded into more valuable products via conventional processing techniques.

The art is replete with processes for converting solid hydrocarbonaceous materials, such as coal, to mixtures of gaseous and liquid products. The following examples are representative of the many such processes. The Synthoil process, developed at the U.S. Bureau of Mines and described by Yavorsky et al. in Chem. Eng. Progress, 69, (3), 51-2 (1973), the H-Coal process, developed by Hydrocarbon Research, Inc. and described in a series of patents including Johanson, U.S. Pat. No. Re. 25,770, Schuman et al., U.S. Pat. No. 3,321,393 and Wolk et al., U.S. Pat. No. 3,338,820, and the Solvent-Refined Coal (SRC) process I and II developed by the Gulf Mineral Resources Co. and described in "Recycle SRC Processing for Liquid and Solid Fuels", presented at 4th Int. Conf. on Coal Gasification, Liquefaction and Conversion to Electricity, Univ. of Pittsburgh (Aug. 2-4, 1977), are representative. The Synthoil and H-Coal processes are generally characterized by a fixed or ebullated catalytic bed.

Recently, high pressure hydrogenation and solvent extraction techniques have been developed, the latter of which is related to the process of this invention. In the process of solvent extraction known to the prior art, crushed, finely-divided particulate coal is placed in contact with a liquid solvent which dissolves a part of the solid, usually in the presence of hydrogen gas. Following the contact, the liquid solvent and the liquefied part of the solid are separated from the remaining solid material by filtration, centrifuging or a similar operation.

One of the problems encountered in the solvent extraction method of liquefying coal has been the ability to recover the maximum quantity of coal extract while minimizing the ash content of the coal extract in order to permit subsequent conventional hydrocarbon processing techniques. A portion of this problem is that hydrocarbons adhere to and are adsorbed in the solids or ash and another portion of this problem is the difficulty of finally separating the liquid hydrocarbons from the ash. Thus the recovery of the maximum quantity of coal extract while minimizing the ash content of the coal extract is a desirable goal.

Another source of primary coal liquids which may be processed according to the method of this invention is the pyrolysis of coal. In the production of more highly refined hydrocarbonaceous products from coal pyrolysis liquids, it is also important to recover the maximum quantity of hydrocarbons while minimizing the ash content in order to permit subsequent conventional hydrocarbon processing techniques.

BRIEF SUMMARY OF THE INVENTION

In the process wherein coal liquids are deashed by means of a selective solvent extraction, it has been found that more deashed coal liquids can be more economically recovered from the primary coal liquids by initially contacting the coal liquids and the primary solvent at a temperature above the selected selective solvent extraction temperature, by subsequently contacting the primary solvent and coal liquid admixture with a secondary solvent at a temperature lower than primary solvent contact temperature, then cooling the coal liquids together with primary and secondary solvents to the selected selective solvent extraction temperature and then performing the desired deashing extraction. By so doing, the coal liquid hydrocarbons which remain in close association with the ash are dissolved and solubilized. Subsequent cooling results in the agglomeration of high melting point material with the solids or ash thereby increasing the effectiveness and operability of the separation.

DETAILED DESCRIPTION OF THE INVENTION

The objective of this invention is to present a process for deashing coal liquids with a selective multi-solvent extraction wherein the coal liquids and a primary selective solvent are contacted initially at a temperature greater than the temperature at which the deashing extraction occurs, then the resulting coal liquid and primary solvent admixture is contacted with a secondary solvent at a temperature lower than the primary solvent contact temperature, then cooling the coal liquids together with primary and secondary solvents to the selected selective extraction temperature and then performing the desired deashing extraction.

Another objective is an efficient method for the recovery of ashless hydrocarbons from coal. Yet another objective is a more economical method for the deashing of coal liquids with a multi-solvent extraction without the disadvantage of excessive solvent heating costs.

As hereinabove set forth, these objects are accomplished through the utilization of multi-solvents together with selected operating parameters including temperature for the recovery of ashless hydrocarbons from coal. Therefore in one embodiment the present invention provides a process for deashing coal by selective multi-solvent extraction which comprises: (a) admixing said coal liquids and a first selective solvent at a temperature greater than a preselected deashing extraction temperature; (b) admixing the resulting admixture from step (a) with a second selective solvent at a temperature less than said temperature of step (a); and (c) deashing said coal extract at said preselected deashing extraction temperature.

In the preferred embodiment of my invention coal liquids are admixed with a primary solvent, subsequently admixed with a secondary solvent and then deashed with each successive step performed at a lower temperature.

The solid carbonaceous material utilized to produce coal extract which is subsequently utilized in the process of this invention may be any type of coal. Any selected coal which has been subjected to liquefaction may act as a source for the coal extract which is utilized in the process of the invention.

Suitable solvents include those selected from the group of light hydrocarbons including ethane, methane, propane, butane, isobutane, pentane, isopentane, neopentane, hexane, isohexane, heptane, the mono-olefinic counterparts thereof, aromatic compounds including benzene and toluene, heavier aliphatic hydrocarbons up to about $C_{16}$, cycloparaffins, naphtha boiling range hydrocarbons, hydro-treated naphtha boiling range hydrocarbons, coal derived hydrocarbons, etc. Furthermore, the solvent may be a normally liquid naphtha fraction containing hydrocarbons having from about 5 to about 14 carbon atoms per molecule, and preferably a naphtha distillate having an end boiling point below about 350° F., with respect to the group of light hydrocarbons containing from about 3 to about 7 carbon atoms per molecule.

The solvents selected for use as the primary solvent preferably demonstrates a propensity to solubilize a greater quantity of the primary coal liquids than the solvent selected for the secondary solvent. This has the beneficial effect of more thoroughly dissolving and solubilizing material that is adhered to and absorbed on the solids. For example, when utilizing toluene and hexane as multi-solvents the primary coal liquid is preferably contacted with the toluene as the primary solvent and then contacted with hexane as the secondary solvent.

Operating conditions during the heating, contacting and extracting operations will be selected according to the characteristics of the coal solvent, the selected primary and secondary solvent and the desired product quality. Preferred operating conditions for the deashing or solvent extraction step include a temperature of from about 250° F. to about 500° F., a pressure of from about 10 to about 1000 psig, and a total solvent to oil ratio of from about 1:1 to about 10:1. Regardless of the operating conditions which are selected, it is critical to the operation of this invention that the coal liquid and the primary solvent is admixed at a temperature greater than a preselected deashing extraction temperature, that the admixture of the coal liquid and the primary solvent is contacted with a secondary solvent at a temperature less than that utilized with the primary solvent and that the resulting admixture of coal liquid, primary solvent and secondary solvent is deashed at the preselected deashing extraction temperature.

The following examples are presented in illustration of my invention. In presenting these examples, it is not intended that the invention be limited to the specific illustrations, nor is it intended that a given process be limited to the particular operating conditions, solvents, coal liquids, processing techniques, etc. It is understood, therefore, that the present invention is merely illustrated by the specifics hereinafter set forth.

EXAMPLE I

In this example, a typical coal liquid obtained from coal liquefaction having the properties presented in Table I is utilized in a solvent deashing experiment with a toluene-hexane solvent containing 25 volume percent toluene. The experiment is performed at a pressure of 400 psig, a solvent to coal liquid ratio, volume basis, of 4, a residence time of 50 minutes and an extraction temperature of 165° C. The resulting deashed oil represented 84 weight percent of the coal liquid feed and contained less than 0.001 weight percent ash. These results are summarized in Table II.

TABLE I

| COAL EXTRACT PROPERTIES | |
|---|---|
| GRAVITY, °API @ 60° F. | −5.7 |
| Distillation (ASTM D-1160) | |
| IBP, °F. | 395 |
| 10% | 510 |
| 30% | 642 |
| 50% | 762 |
| 70% | 945 |
| % OVER | 70.0 |
| % BOTTOM | 30.0 |
| HEPTANE INSOLUBLE, WT. % | 19.0 |
| BENZENE INSOLUBLE, WT. % | 6.3 |
| ASH (ASTM), WT. % | 1.4 |

EXAMPLE II

This example is an illustration of the process of the present invention. A portion of the coal liquids having the properties described in Table I is admixed with a toluene solvent at a temperature of 220° C. with a solvent to coal liquid ratio, volume basis, of 1, the resulting coal liquid and toluene admixture is contacted with a hexane solvent at a temperature of 175° C. with a solvent to coal liquid ratio, volume basis, of 3 and the resulting admixture is then deashed at a pressure of 590 psig, a residence time of 50 minutes with an extraction temperature of 165° C. The resulting deashed oil represents 90 weight percent of the coal liquid feed and contained less than 0.001 weight percent ash. These results are also summarized in Table II.

TABLE II

COAL EXTRACT DEASHING COMPARISON

| SOLVENT | EXAMPLE I TOLUENE/ HEXANE BLEND | EXAMPLE II TOLUENE/ HEXANE |
|---|---|---|
| PRIMARY MIXER TEMPERATURE, °C. | — | 220 |
| SECONDARY MIXER TEMPERATURE, °C. | — | 175 |
| EXTRACTION TEMPERATURE, °C. | 165 | 165 |
| PRIMARY SOLVENT OIL RATIO (VOLUME) | 4 | 1 |
| SECONDARY SOLVENT OIL RATIO (VOLUME) | — | 3 |
| RESIDENCE TIME, MINUTES | 50 | 50 |
| DEASPHALTED OIL YIELD, WT. % | 84 | 90 |
| ASH, WT. % | .001 | .001 |

The foregoing specification and examples clearly illustrate the improvements encompassed by the present invention and the benefits to be afforded a process for deashing primary coal liquids.

I claim as my invention:

1. In a process for deashing coal liquid by primary and secondary solvent extraction at a deashing solvent extraction temperature, the method which comprises:

(a) admixing said coal liquid and a first selective solvent having a greater propensity to solubilize a greater quantity of the primary coal liquids than the hereinafter defined secondary solvent of step (b) at a temperature higher than said deashing solvent extraction temperature;

(b) admixing the resulting admixture from step (a) with a second selective solvent having less propensity to solubilize a greater quantity of the primary coal liquids than said primary solvent of step (a) at a temperature lower than that of said step (a);

(c) cooling said coal liquids, and primary and secondary solvents to the selective solvent extraction temperature; and (d) deashing said coal liquid by solvent extraction with said solvents at said deashing solvent extraction temperature.

2. The process of claim 1 wherein said first solvent is toluene.

3. The process of claim 1 wherein said second solvent is hexane.

4. The process of claim 1 wherein said deashing is performed at a temperature from about 250° F. to about 500° F.

5. The process of claim 1 wherein said deashing is performed at a pressure from about 10 to about 1000 psig.

6. The process of claim 1 wherein said deashing is performed with a total solvent to oil ratio of from about 1:1 to about 10:1.

* * * * *